US010697456B2

(12) United States Patent
Lee et al.

(10) Patent No.: US 10,697,456 B2
(45) Date of Patent: Jun. 30, 2020

(54) SCROLL COMPRESSOR FRAME AND ORBITING SCROLL AND SEALING THEREOF

(71) Applicant: LG ELECTRONICS INC., Seoul (KR)

(72) Inventors: Howon Lee, Seoul (KR); Jungsun Choi, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 433 days.

(21) Appl. No.: 15/451,803

(22) Filed: Mar. 7, 2017

(65) Prior Publication Data

US 2017/0306957 A1 Oct. 26, 2017

(30) Foreign Application Priority Data

Apr. 26, 2016 (KR) ..... 10-2016-0051051

(51) Int. Cl.
*F04C 27/00* (2006.01)
*F04C 23/00* (2006.01)
*F04C 18/02* (2006.01)

(52) U.S. Cl.
CPC ..... *F04C 27/008* (2013.01); *F04C 18/0215* (2013.01); *F04C 18/0253* (2013.01); *F04C 23/008* (2013.01); *F04C 27/005* (2013.01)

(58) Field of Classification Search
CPC ..... F04C 27/001; F04C 27/005; F04C 27/008
See application file for complete search history.

(56) References Cited

U.S. PATENT DOCUMENTS 5,212,964 A 5/1993 Utter et al.
5,263,822 A * 11/1993 Fujio ..... F04C 18/0215 418/55.4
7,614,860 B2 * 11/2009 Yano ..... F04C 18/0223 418/210

FOREIGN PATENT DOCUMENTS

CN 1131238 9/1996
CN 101802407 8/2010
(Continued)

OTHER PUBLICATIONS

Machine translation of JP 2009-97350, Matsui, The NPL publication date is May 7, 2009. (Year: 2009).*
(Continued)

*Primary Examiner* — Mary Davis
(74) *Attorney, Agent, or Firm* — Fish & Richardson P.C.

(57) ABSTRACT

A scroll compressor is provided that may include a motor; an orbiting scroll; a fixed scroll coupled to the orbiting scroll, and forming a compression chamber together with the orbiting scroll; a frame coupled to the fixed scroll, and configured to support the orbiting scroll; a sealing member mounting groove having a ring shape, and formed on a first surface of the frame contacting the orbiting scroll, or a second surface of the orbiting scroll contacting the frame; and a sealing member including a first sealing portion formed in a ring shape, inserted into the sealing member mounting groove so as to be moveable in an axial direction, and configured to perform a sealing operation between the frame and the orbiting scroll in the axial direction and including a second sealing portion extending from the first sealing portion in the axial direction, and configured to perform a sealing operation between the frame and the orbiting scroll in a radial direction by contacting an outer side wall surface of the sealing member mounting groove A thickness of the second sealing portion in the radial direction
(Continued)

may be smaller than a thickness of the first sealing portion in the axial direction.

20 Claims, 12 Drawing Sheets

(56) References Cited

FOREIGN PATENT DOCUMENTS

| | | |
|---|---|---|
| CN | 202431523 | 9/2012 |
| EP | 2863059 | 4/2015 |
| JP | 1991105090 | 5/1991 |
| JP | 07-247967 | 9/1995 |
| JP | 11-182462 | 7/1999 |
| JP | 2002054583 | 2/2002 |
| JP | 2009-097356 | 5/2009 |
| JP | 2009097356 | 5/2009 |
| KR | 20-2000-0015867 | 8/2000 |
| KR | 10-2005-0082632 | 8/2005 |

OTHER PUBLICATIONS

International Search Report dated Apr. 18, 2017 issued in Application No. PCT/KR2017/000274.
Chinese Office Action in Chinese Application No. 201780024394.6, dated May 13, 2019, 15 pages (with English translation).
Extended European Search Report in European Application No. 17789742.8, dated Nov. 27, 2019, 7 pages.

* cited by examiner

SCROLL COMPRESSOR FRAME AND ORBITING SCROLL AND SEALING THEREOF

CROSS-REFERENCE TO RELATED APPLICATION(S)

Pursuant to 35 U.S.C. § 119(a), this application claims the benefit of an earlier filing date of and the right of priority to Korean Application No. 10-2016-0051051, filed in Korea on Apr. 26, 2016, the contents of which are incorporated by reference herein in its entirety.

BACKGROUND

1. Field

A scroll compressor and more particularly, a scroll compressor having a compression device disposed below a motor is disclosed herein.

2. Background

Generally, scroll compressors are widely used in air conditioners, in order to compress a refrigerant, due to advantages that a compression ratio is relatively higher than that of other types of compressors, and a stable torque is obtainable as processes for suctioning, compressing, and discharging a refrigerant are smoothly performed.

A behavior characteristic of the scroll compressor is determined by a non-orbiting wrap (hereinafter, referred to as a "fixed wrap") of a non-orbiting scroll (hereinafter, referred to as a "fixed scroll") and an orbiting wrap of an orbiting scroll. The fixed wrap and the orbiting wrap may have any shape, but they generally have a shape of an involute curve for easy processing. The term "involute curve" means a curved line corresponding to a moving path drawn by the end of a thread when the thread wound around a basic circle having any radius is unwound. In a case of using such an involute curve, the fixed wrap and the orbiting wrap stably perform a relative motion as they have a constant thickness, thereby forming a compression chamber to compress a refrigerant.

The scroll compressor may be categorized into a tip seal method and a back pressure method according to a method of sealing a compression chamber. According to the tip seal method, a tip seal is provided at a sectional surface of a wrap, and the tip seal is upward moved by a compressed refrigerant. Then, the tip seal contacts a plate to seal a compression chamber. On the other hand, according to the back pressure method, a back pressure chamber which forms an intermediate pressure is formed on a rear surface of an orbiting scroll or on a rear surface of a fixed scroll. Then, one of the orbiting scroll or the fixed scroll pressurizes the other by a pressure of the back pressure chamber. As a result, an end surface of one wrap contacts a plate of the other scroll, thereby sealing a compression chamber. In a case of the back pressure method, a sealing member is provided between a rear surface of an orbiting scroll (or a rear surface of a fixed scroll) and a frame corresponding thereto, and a back pressure chamber is formed by the sealing member.

FIG. 1 is a longitudinal sectional view illustrating an example of a lower compression type scroll compressor in accordance with the conventional art.

As shown, the conventional lower compression type scroll compressor includes a casing 1; a motor part or motor 2 provided at an inner space 1*a* of the casing 1, and having a stator 21 and a rotor 22 of a drive motor; a compression part or device 3 provided below the motor part 2; and a rotational shaft 5 configured to transmit a rotational force of the motor part 2 to the compression part 3.

A refrigerant suction pipe 15 that communicates with the compression part 3 is connected to a lower part of the casing 1. A refrigerant discharge pipe 16, configured to discharge a refrigerant discharged to the inner space 1*a* of the casing 1 to a refrigerating cycle, is connected to an upper part of the casing 1.

The compression part 3 includes a main frame 31 fixed to an inner circumferential surface of the casing 1 below the stator 21; a fixed scroll 32 coupled to a lower side of the main frame 31; and an orbiting scroll 33 disposed between the main frame 31 and the fixed scroll 32, coupled to an eccentric portion 53 of the rotational shaft 5 to perform an orbiting motion, and forming a pair of compression chambers (V) between itself and the fixed scroll 32.

An Oldham's ring 35 to prevent a rotation of the orbiting scroll 33 may be installed between a rear surface of the orbiting scroll 33 and the main frame 31 corresponding thereto. A sealing member 36, which forms a back pressure chamber on the rear surface of the orbiting scroll 33, may be installed at an inner side than the Oldham's ring 35.

As shown in FIG. 2, the sealing member 36 has a quadrangular sectional surface, and a ring shape with a cut-out portion 36*a* is provided at an intermediate region of the sealing member 36 in a circumferential direction, in a stair-stepped or inclined manner. The sealing member 36 may have a structure to seal a sealing member insertion groove of the orbiting scroll 33 in a radial direction. Once the cut-out portion 36*a* of the sealing member 36 is widened by an inner pressure of the sealing ember 36, an outer circumferential surface of the sealing member 36 contacts an inner circumferential surface of the sealing member insertion groove.

An unexplained reference numeral 33*c* denotes a rotational shaft coupling portion.

In the conventional lower compression type scroll compressor, the orbiting scroll 33 performs an orbiting motion with respect to the fixed scroll 32 by a driving force provided from the or part 2, thereby forming a pair of compression chambers (V) including a suction chamber, an intermediate pressure chamber, and a discharge chamber. The scroll compressor compresses a refrigerant introduced into the compression chambers (V), and discharges the compressed refrigerant to an inner space of a discharge cover 34.

Then the refrigerant discharged to the inner space of the discharge cover 34 is moved to the inner space 1*a* of the casing 1. As a result, the refrigerant is discharged to a refrigerating cycle through the discharge pipe 16, and oil separated from the refrigerant is collected in an oil storage space 1*b* provided at a lower part of the casing 1. Such processes are repeatedly performed.

In this case, the orbiting scroll 33 is moved with respect to the fixed scroll 32 in an axial direction, by a pressure of the compression chambers (V). However, as a back pressure chamber (S) formed by the orbiting scroll 33, the main frame 31, and the fixed scroll 32 is provided on a rear surface of the orbiting scroll 33 together with the sealing member 36, levitation of the orbiting scroll 33 is prevented by a pressure of the back pressure chamber (S). This may prevent separation of end surfaces of a fixed wrap 32*b* and an orbiting wrap 33*b*, from plate portions 32*a*, 33*a* of the fixed scroll 32 and the orbiting scroll 33 corresponding thereto. As a result, leakage of a refrigerant compressed in the compression chambers (V) in an axial direction may be prevented.

However, the conventional lower compression type scroll compressor may have the following problems.

First, with a structure that the sealing member 36 having the cut-out portion 36*a* is formed in a ring shape, pressure leakage through the cut-out portion 36*a* may occur. This may cause a pressure of the back pressure chamber (S) not to be maintained uniformly.

Second, if the pressure of the back pressure chamber (S) is not constant, the orbiting scroll 33 has an unstable behavior. This may lower a sealing force with respect to the compression chambers (V) between the orbiting scroll 33 and the fixed scroll 32, and may cause a compression loss.

Third, the sealing member 36 may be damaged when applied to a compressor of a high compression ratio, as the cut-out portion 36*a* has lowered reliability.

Fourth, as the sealing member 36 has a quadrangular sectional surface, an entire weight of the sealing member 36 may be increased. As a result, when the scroll compressor is initially driven, the sealing member 36 may not be rapidly levitated. This may delay formation of the back pressure chamber.

Fifth, if a thickness of the sealing member 36 in an axial direction is small, a sealing area in a radial direction may be reduced, and the sealing member 36 may have a shortened lifespan due to abrasion with the main frame 31. On the other hand, if a width of the sealing member 36 in the radial direction is small, a sealing area in the axial direction may be reduced, and a pressure-applied area with respect to a weight of the sealing member may be reduced. This may delay levitation of the sealing member 36.

BRIEF DESCRIPTION OF THE DRAWINGS

Embodiments will be described in detail with reference to the following drawings in which like reference numerals refer to like elements, and wherein.

DETAILED DESCRIPTION

Figure 1:
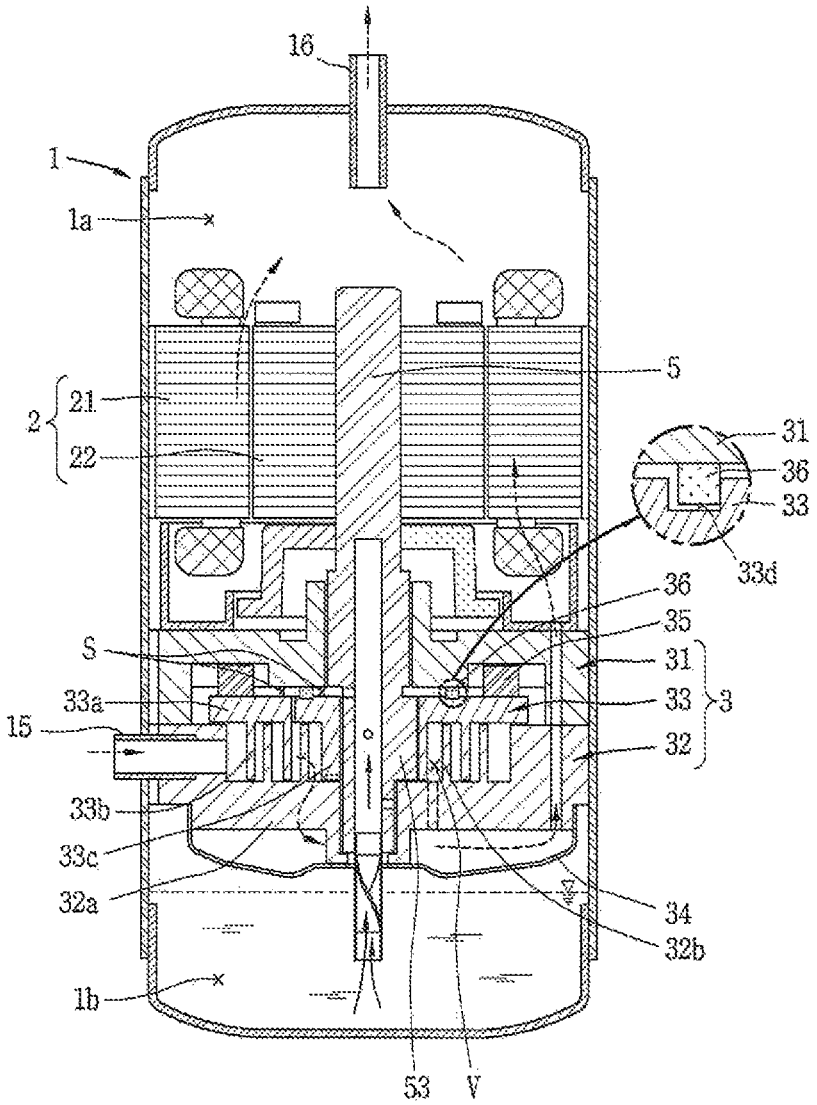
FIG. 1 CONVENTIONAL ART
FIG. 1 is a longitudinal sectional view illustrating an example of a lower compression type scroll compressor in accordance with the conventional art.

Hereinafter, a scroll compressor according to embodiments will be explained in more detail with reference to the attached drawings. Where possible, like reference numerals have been used to indicate like elements, and repetitive disclosure has been omitted.

For your reference, the scroll compressor according to embodiments is related to a structure to enhance a sealing force and durability of a sealing member which forms a back pressure chamber by being installed between an orbiting scroll and a main frame corresponding thereto. Thus, the embodiments may be applied to any type of scroll compressor which has a sealing member between an orbiting scroll and a member contacting the orbiting scroll. However, for convenience, a lower compression type scroll compressor where a compression part is disposed below a motor part will be explained, more specifically a scroll compressor where a rotational shaft is overlapped with an orbiting wrap on a same plane. Such a scroll compressor is applicable to a refrigerating cycle of a high temperature and a high compression ratio.

Figure 3:
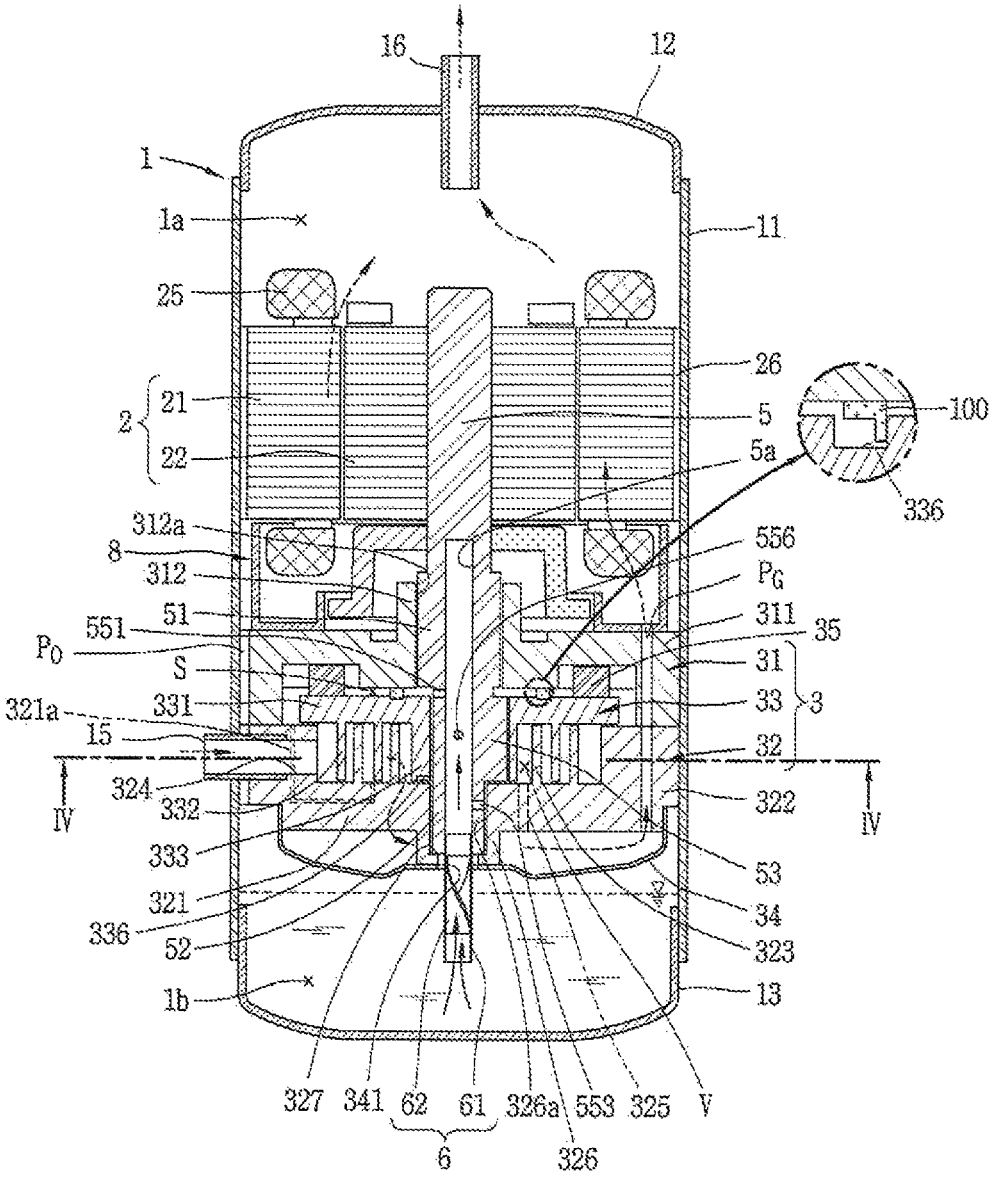
FIG. 3 is a longitudinal sectional view illustrating an example of a lower compression type scroll compressor according to an embodiment.
Figure 4:
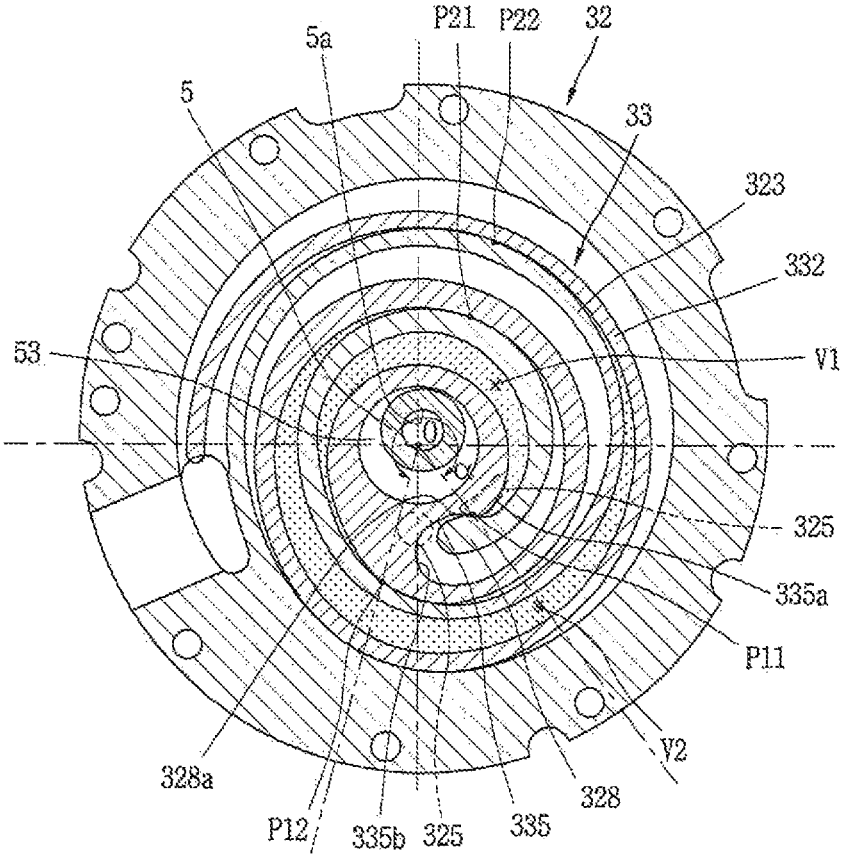
FIG. 4 is a sectional view taken along line IV-IV in FIG. 3.

FIG. 3 is a longitudinal sectional view illustrating an example of a lower compression type scroll compressor according to an embodiment. FIG. 4 is a sectional view taken along line 'IV-IV' in FIG. 3.

Referring to FIG. 3, in the lower compression type scroll compressor according to an embodiment, a motor part 2 which generates a rotational force in the form of a drive motor may be installed or provided at an inner space 1*a* of a casing 1. A compression part or device 3 that compresses a refrigerant by receiving the rotational force of the motor part 2 may be installed or provided below the motor part 2.

The casing 1 may include a cylindrical shell 11 which forms a hermetic container, an upper shell 12 which forms the hermetic container together by covering an upper part or portion of the cylindrical shell 11, and a lower shell 13 which forms the hermetic container together by covering a lower part or portion of the cylindrical shell 11 and which forms an oil storage space 1*b*.

A refrigerant suction pipe 5 may be penetratingly-formed at a side surface of the cylindrical shell 11, thereby directly communicating with a suction chamber of the compression part 3. A refrigerant discharge pipe 16 that, communicates with the inner space 1*a* of the casing 1 may be installed or provided at an upper part or portion of the upper shell 12. The refrigerant discharge pipe 16 may be a passage along which a refrigerant compressed by the compression part 3 and discharged to the inner space 1*a* of the casing 1 may be discharged to the outside. An oil separator (not shown) that separates oil mixed with the discharged refrigerant may be connected to the refrigerant discharge pipe 16.

A stator 21 which forms, the motor part 2 may be fixed to an upper part or portion of the casing 1, and a rotor 22 which constitutes or forms the motor part 2 together with the stator 21 and rotated by a reciprocal operation with the stator 21 may be rotatably installed or provided in the stator 21. A plurality of slots (not shown) may be formed on an inner circumferential surface of the stator 21 in a circumferential direction, on which a coil 25 may be wound. An oil collection passage 26 configured to pass oil therethrough may be formed between an outer circumferential surface of the stator 21 and an inner circumferential surface of the cylindrical shell 11, in a D-cut shape, for example.

A main frame 31 which constitutes or forms the compression part 3 may be fixed to an inner circumferential surface of the casing 1, below the stator 21 with a predetermined gap therebetween. The main frame 31 may be coupled to the cylindrical shell 11 as an outer circumferential surface of the main frame 31 is, for example, welded or shrink-fit to an inner circumferential surface of the cylindrical shell 11.

A ring-shaped frame side wall portion or side wall (first side wall portion or side wall) 311 may be formed at an edge of the main frame 31, and a first shaft accommodating portion 312 configured to support a main bearing portion 51 of a rotational shaft 5, which is discussed hereinafter, may be formed at a central part or portion of the main frame 31. A first shaft accommodating hole 312*a*, configured to rotatably receive the main bearing portion 51 of the rotational shaft 5 and support the main bearing portion 51 in a radial direction, may be penetratingly-formed at the first shaft accommodating portion 312 in an axial direction.

A fixed scroll 32 may be installed or provided at a bottom surface of the main frame 31, in a state where an orbiting scroll 33 eccentrically-coupled to the rotational shaft 5 is disposed between the fixed scroll 32 and the main frame 31. The fixed scroll 32 may be fixedly-coupled to the main frame 31 and may be fixed to the main free 31 so as to be moveable in the axial direction.

The fixed scroll 32 may include a fixed plate portion or plate (hereinafter, referred, to as a "first plate portion" or "plate") 321 formed in an approximate disc shape, and a scroll side wall portion (hereinafter, referred to as a "second side wall portion" or "side wall") 322 formed at an edge of the first plate portion 321 and coupled to an edge of a bottom surface of the main frame 31.

A fixed wrap 323, which forms a compression chamber (V) by being engaged with an orbiting wrap 332, which is discussed hereinafter, may be formed on an upper surface of the first plate portion 321. The compression chamber (V) may be formed between the first plate portion 321 and the fixed wrap 323, and between the orbiting wrap 332, which is discussed hereinafter and the second plate portion 331. The compression chamber (V) may be implemented as a suction chamber, en intermediate pressure chamber, and a discharge chamber consecutively formed in a moving direction of the wrap.

The compression chamber (V) may include a first compression chamber (V1) formed between an inner side surface of the fixed wrap 323 and an outer side surface of the orbiting wrap 332, and a second compression chamber (V2) formed between an outer side surface of the fixed wrap 323 and an inner side surface of the orbiting wrap 332. That is, as shown in FIG. 4, the first compression chamber (V1) may be formed between two contact points (P11, P12) generated as the inner side surface of the fixed wrap 323 and the outer side surface of the orbiting wrap 332 come to contact with each other. Under an assumption that a largest angle among angles formed by two lines which connect a center (O) of an eccentric portion with two contact points (P11, P12) is $\alpha$, a formula ($\alpha<360°$) is formed before a discharge operation is started. The second compression chamber (V2) may be formed between two contact points (P21, P22) generated as the outer side surface of the fixed wrap 323 and the inner side surface of the orbiting wrap 332 come in contact with each other.

The first compression chamber (V1) may be formed such that a refrigerant is first suctioned thereinto rather than into the second, compression chamber (V2), and such that a compression path thereof is relatively long. However, as the orbiting wrap 332 is formed with irregularity, a compression ratio of the first compression chamber (V1) may be lower than a compression ratio of the second compression chamber (V2). Further, the second compression chamber (V2) may be formed such that a refrigerant is later suctioned thereinto rather than into the first compression chamber (V1), and such that a compression path thereof is relatively short. However, as the orbiting wrap 332 is formed with irregularity, the compression ratio of the second compression chamber (V2) may be higher than the compression ratio of the first compression chamber (V1).

A suction opening 324, through which the refrigerant suction pipe 15 and a suction chamber may communicate with each other, may be penetratingly-formed at one side of the second side wall portion 322. A discharge opening 325, which communicates with a discharge chamber and through which a compressed refrigerant may be discharged, may be formed at a central part or portion of the first plate portion 321. The discharge opening 325 may be formed as one opening that communicate with both of the first and second compression chambers (V1, V2). Alternatively, the discharge opening 325 may be formed as a plurality of openings that communicates with the first and second compression chambers (V1 V2).

A second shaft accommodation portion 326, configured to support a sub bearing portion 52 of the rotational shaft 5, which is discussed hereinafter, may be formed at the central part of the first plate portion 321 of the fixed scroll 32. A second shaft accommodating hole 326*a*, configured to support the sub bearing portion 52 in the radial direction, may be penetratingly-formed at the second shaft accommodating portion 326 in the axial direction.

A thrust bearing portion 327, configured to support a lower end surface of the sub bearing portion 52 in the axial direction, may be formed at a lower end of the second shaft accommodation portion 326. The thrust bearing portion 327 may protrude from a lower end of the second shaft accommodating hole 326*a* in the radial direction, towards a shaft center. However, the thrust bearing portion 327 may be formed between a bottom surface of an eccentric portion 53 of the rotational shaft 5, which is discussed hereinafter, and the first plate portion 321 of the fixed scroll 32 corresponding thereto.

A discharge cover 34, configured to accommodate a refrigerant discharged from the compression chamber (V) therein and to guide the refrigerant to a refrigerant passage, which is discussed hereinafter, may be coupled to a lower side of the fixed scroll 32. The discharge cover 34 may be formed such that an inner space thereof may accommodate therein the discharge opening 325 and may accommodate therein an inlet of a refrigerant passage ($P_G$) along which a refrigerant discharged from the compression chamber (V1) may be guided to the inner space 1*a* of the casing 1.

The refrigerant passage ($P_G$) may be penetratingly-formed at the second side wall portion 322 of the fixed scroll 32 and the first side wall portion 311 of the main frame 31, sequentially, et an inner side of an oil passage separation portion 8. Alternatively, the refrigerant passage ($P_G$) may be formed so as to be consecutively recessed from an outer circumferential surface of the second side wall portion 322 and an outer circumferential surface of the first frame 311.

The orbiting scroll 33 may be installed or provided between the main frame 31 and the fixed scroll 32 so as to perform an orbiting motion. An Oldham's ring 35 to prevent rotation of the orbiting scroll 33 may be installed or provided between an upper surface of the orbiting scroll 33 and a bottom surface of the main frame 31 corresponding thereto, and a sealing member 100, which forms a back pressure chamber (S), may be installed or provided at an inner side than the Oldham's ring 35. Thus, the back pressure chamber (S) may be implemented as a space formed by the main frame 31, the fixed scroll 32, and the orbiting scroll 33, outside of the sealing member 100. The back pressure chamber (S) forms an intermediate pressure because a refrigerant of an intermediate pressure is filled therein as the back pressure chamber (S) communicates with the intermediate compression chamber (V) by a back pressure hole 321*a* provided at the fixed scroll 32. However, a space formed at an inner side than the sealing member 100 may also serve as a back pressure chamber as oil of high pressure is filled therein.

An orbiting plate portion or plate (hereinafter, referred to as a "second plate portion" or "second plate") 331 of the orbiting scroll 33 may be formed to have an approximate disc shape. The back pressure chamber (S) may be formed at an upper surface of the second plate portion 331, and the orbiting wrap 332, which forms the compression chamber by being engaged with the fixed wrap 322, may be formed at a bottom surface of the second plate portion 331.

The eccentric portion 53 of the rotational shaft 5, which will be discussed hereinafter, may be rotatably inserted into a central part or portion of the second plate portion 331, such that a rotational shaft coupling portion 333 may pass therethrough in the axial direction. The rotational shaft coupling portion 333 may extend from the orbiting wrap 332 so as to form an inner end of the orbiting wrap 332. Thus, as the rotational shaft coupling portion 333 is formed to have a height high enough to be overlapped with the orbiting wrap 332 on a same plane, the eccentric portion 53 of the rotational shaft 5 may be overlapped with the orbiting wrap 332 on the same plane. With such a configuration, a repulsive force and a compressive force of a refrigerant may be applied to the same plane on the basis of the second plate portion to be attenuated from each other. This may prevent a tilted state of the orbiting scroll 33 due to the compressive force and the repulsive force.

Figure 2:
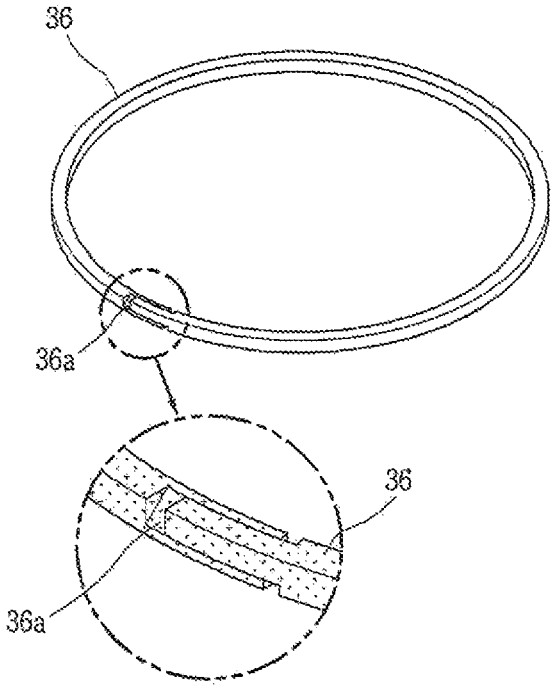
FIG. 2 CONVENTIONAL ART
FIG. 2 is a perspective view illustrating a sealing member in the scroll compressor of FIG. 4.

An outer circumference of the rotational shaft coupling portion 333 may be connected to the orbiting wrap 332 to form the compression chamber (V) during a compression operation together with the fixed wrap 322. The orbiting wrap 332 may be formed to have an involute shape together with the fixed wrap 323. However, the orbiting wrap 332 may be formed to have various shapes. For example, as shown in FIG. 2, the orbiting wrap 332 and the fixed wrap 323 may be formed to have a shape implemented as a plurality of circles of different diameters and origin points connected to each other, and a curved line of an outermost side may be formed as an approximate oval having a long axis and a short axis.

A protrusion 328 that protrudes toward an outer circumference of the rotational shaft coupling portion 333, may be formed near an inner end (a suction end or a starting end) of the fixed wrap 323. A contact portion 328*a* may protrude from the protrusion 328. That is, the inner end of the fixed wrap 323 may be formed to have a greater thickness than other parts or portions, With such a configuration, the inner end of the fixed wrap 323, having a largest compressive force among other parts or portions of the fixed wrap 323, may have an enhanced wrap intensity and may have enhanced durability.

A concaved portion 335, engaged with the protrusion 328 of the fixed wrap 323, may be formed at the outer circumference of the rotational shaft coupling portion 333 which is opposite to the inner end of the fixed wrap 323. An increased thickness portion 335*a*, having its thickness increased from an inner circumferential part or portion of the rotational shaft coupling portion 333 to an outer circumferential part or portion thereof, may be formed at one side of the concaved portion 335, at an upstream side in a direction to form the compression chambers (V). This may enhance the compression ratio of the first compression chamber (V1) by shortening a length of the first compression chamber (V1) prior to a discharge operation.

A circular arc surface 335*b* having a circular arc shape may be formed at another side of the concaved portion 335. A diameter of the circular arc surface 335*b* may be determined by a thickness of the inner end of the fixed wrap 323 and an orbiting radius of the orbiting wrap 332. If the thickness of the inner end of the fixed wrap 323 is increased, the diameter of the circular arc surface 335*b* is increased. This may allow the orbiting wrap around the circular arc surface 335*b* to have an increased thickness and thus to obtain durability. Further, as a compression path becomes longer, the compression ratio of the second compression chamber (V2) may be increased in correspondence thereto.

The rotational shaft 5 may be supported in the radial direction as an upper part or portion thereof forcibly-coupled to a central part or portion of the rotor 22, and as a lower part or portion thereof may be coupled to the compression part 3. Thus, the rotational shaft 5 transmits a rotational force of the motor part 2 to the orbiting scroll 33 of the compression part 3. As a result, the orbiting scroll 33 eccentrically-coupled to the rotational shaft 5 performs an orbiting motion with respect to the fixed scroll 32.

The main bearing portion 51, supported in the radial direction by being inserted into the first shaft accommodating hole 312*a* of the main frame 31, may be formed at a lower part or portion of the rotational shaft 5. The sub bearing portion 52, supported in the radial direction by being inserted into the second shaft accommodating hole 326*a* of the fixed scroll 32, may be formed below the main bearing portion 51. The eccentric portion 53, inserted into the rotational shaft coupling portion 333 of the orbiting scroll 33, may be formed between the main bearing portion 51 and the sub bearing portion 52.

The main bearing portion 51 and the sub bearing portion 52 may be formed to be concentric with each other, and the eccentric portion 53 may be formed to be eccentric from the main bearing portion 51 or the sub bearing portion 52 in the radial direction. The sub bearing portion 52 may be formed to be eccentric from the main bearing portion 51.

An outer diameter of the eccentric portion 53 may be formed to be smaller than an inner diameter of the main bearing portion 51 but larger than an inner diameter of the sub bearing portion 52, such that the rotational shaft 5 may be easily coupled to the eccentric portion 53 through the shaft accommodating holes 312*a*, 326*a*, and the rotational shaft coupling portion 333. However, in a case of forming the eccentric portion 53 using an additional bearing without integrally forming the eccentric portion 53 with the rotational shaft 5, the rotational shaft 5 may be coupled, to the eccentric portion 53, without the configuration that the outer diameter of the eccentric portion 53 is larger than the inner diameter of the sub bearing portion 52.

An oil supply passage 5*a*, along which oil may be supplied to the bearing portions and the eccentric portion, may be formed the rotational shaft 5. As the compression part 3 is disposed or provided below the motor part 2, the oil supply passage 5*a* may be formed in a chamfering manner from a lower end of the rotational shaft 5 to a lower end of the stator 21 or to an intermediate height of the stator 21, or to a height higher than an upper end of the main bearing portion 51.

An oil feeder 6, configured to pump oil contained in the oil storage space 1*b*, may be coupled to a lower end of the rotational shaft 5, that is, a lower end of the sub bearing portion 52. The oil feeder 6 may include an oil supply pipe 61 insertion-coupled to the oil supply passage 5*a* of the rotational shaft 5, and an oil suctioning member 62 (for example, a propeller) inserted into the oil supply pipe 61 and configured to suction oil.

An oil supply hole and/or an oil supply groove, configured to supply oil suctioned through the oil supply passage to an outer circumferential surface of each of the respective bearing portions and the eccentric portion, may be formed at the respective bearing portions and the eccentric portion, or at a position between the respective bearing portions. Thus, oil suctioned toward an upper end of the main bearing portion 51 along the oil supply passage 5*a* of the rotational shaft 5, an, oil supply hole (not shown) and an oil supply groove (not shown), flows out of bearing surfaces from an upper end of the first shaft accommodating portion 312 of the main frame 31. Then, the oil may flow down onto an upper surface of the main frame 31, along the first shaft accommodating portion 312. Then, the oil may be collected in the oil storage space 1*b*, through an oil passage ($P_O$) consecutively formed on an outer circumferential surface of the main frame 31 (or through a groove that communicates from the upper surface of the main frame 31 to the outer circumferential surface of the main frame 31) and an outer circumferential surface of the fixed scroll 32.

Further, oil, discharged to the inner space 1*a* of the casing 1 from the compression chamber (V) together with a refrigerant, may be separated from the refrigerant at an upper space of the casing 1. Then, the oil may be collected in the oil storage space 1*b* through a passage formed on an outer circumferential surface of the motor part 2, and through the oil passage ($P_O$) formed on an outer circumferential surface of the compression part 3.

The lower compression type scroll compressor according to an embodiment may be operated as follows.

First, once power is supplied to the motor part 2, the rotor 21 and the rotational shaft 5 may be rotated as a rotational force is generated. As the rotational shaft 5 is rotated, the orbiting scroll 33 eccentrically-coupled to the rotational shaft 5 may perform an orbiting motion by the Oldham's ring 35.

As a result, the refrigerant supplied from the outside of the casing 1 through the refrigerant suction pipe 15 may be introduced into the compression chambers (V), and the refrigerant may be compressed as a volume of the compression chambers (V) is reduced by the orbiting motion of the orbiting scroll 33. Then, the compressed refrigerant may be discharged to an inner space of the discharge cover 34 through the discharge opening 325.

Then, the refrigerant discharged to the inner space of the discharge cover 34 may circulate at the inner space of the discharge cover 34, thereby having its noise reduced. Then, the refrigerant may move to a space between the main frame 31 and the stator 21, and move to an upper space of the motor part 2 through a gap between the stator 21 and the rotor 22.

Then, the refrigerant may have oil separated therefrom at the upper space of the motor part 2, and then may be discharged to the outside of the casing 1 through the refrigerant discharge pipe 16. On the other hand, the oil may be collected in the oil storage space, a lower space of the casing 1, through a flow path between an inner circumferential surface of the casing 1 and the stator 21, and through a flow path between the inner circumferential surface of the casing 1 and an outer circumferential surface of the compression part 3. Such processes may be repeatedly performed.

A back pressure chamber, configured to prevent levitation of the orbiting scroll due to a pressure of the compression chamber, may be formed on a rear surface of the orbiting scroll. The back pressure chamber is formed as a sealing member may be provided at a bottom surface of the main frame and the rear surface of the orbiting scroll, and as a space formed by the orbiting scroll, the main frame and the fixed scroll may be separated from the inner space of the casing. Therefore, the sealing member may be formed to have an excellent sealing force between the main frame and the orbiting scroll, and may be formed to have an excellent abrasion resistance considering friction due to an orbiting motion of the orbiting scroll. Further, the sealing member may be formed of a material and formed to be rapidly levitated even at a low pressure, as it performs a sealing operation between the main frame and the orbiting scroll in an axial direction, by being levitated by a pressure in an inserted state into the sealing member insertion groove.

Figure 5:
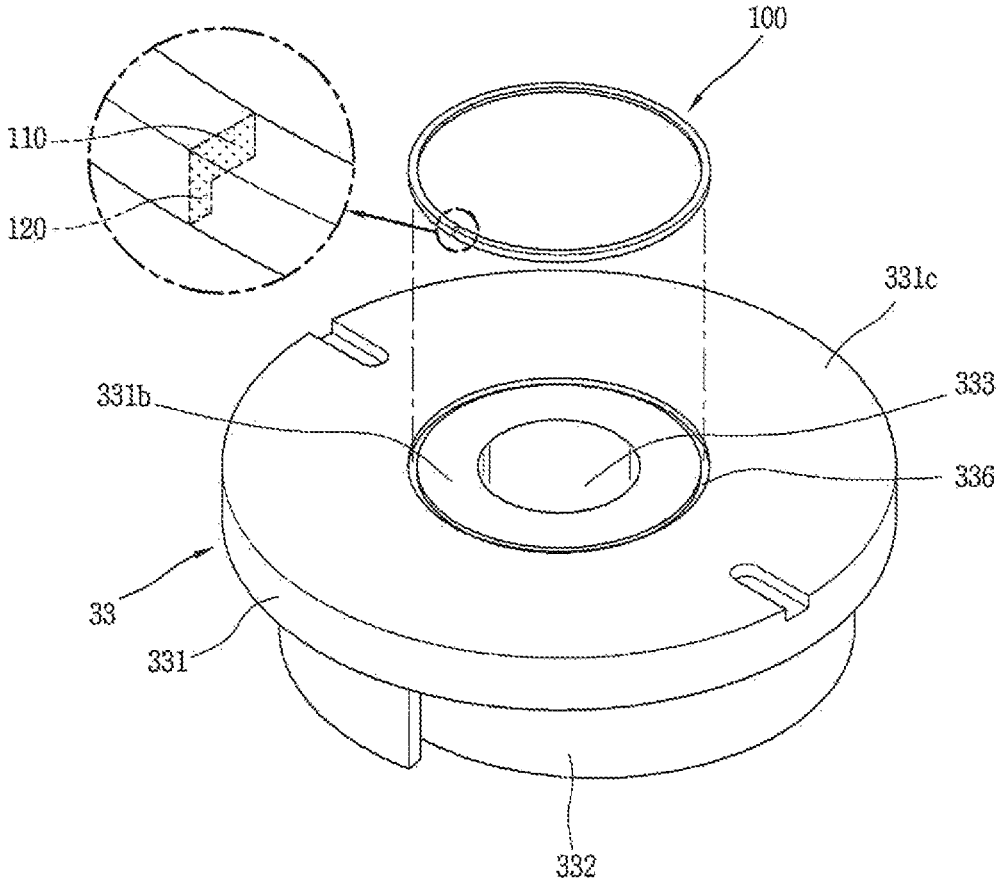
FIG. 5 is a perspective view illustrating a sealing member according to an embodiment.
Figure 6:
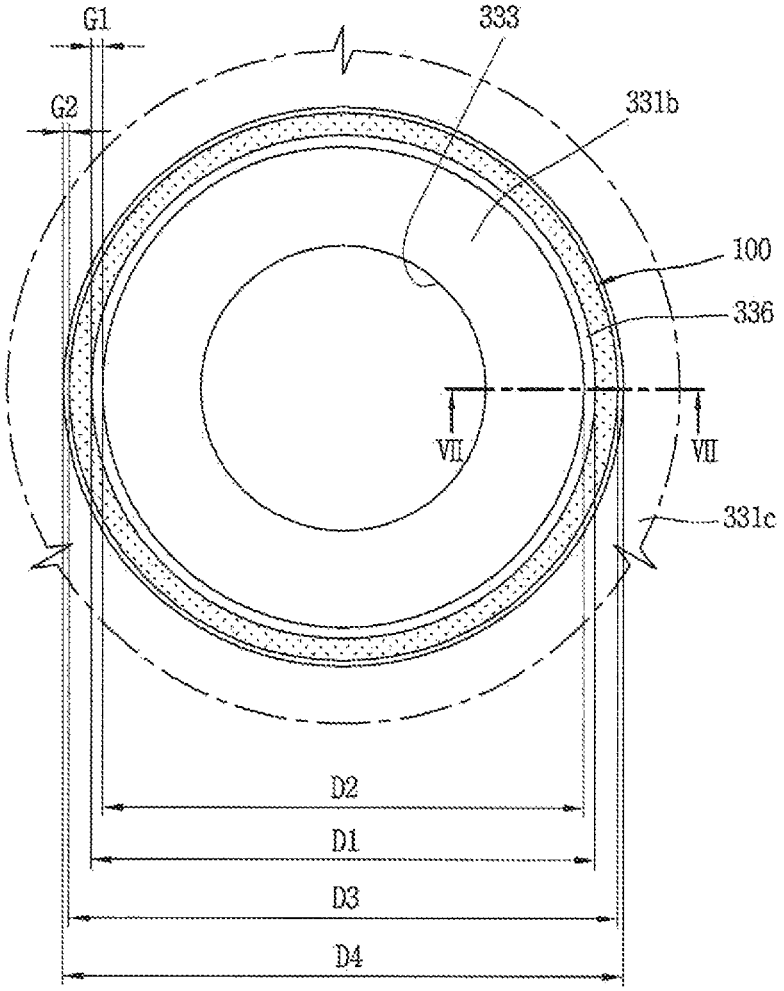
FIG. 6 is a planar view illustrating an inserted state of the sealing member of FIG. 5 into a sealing member insertion hole.
Figure 7:
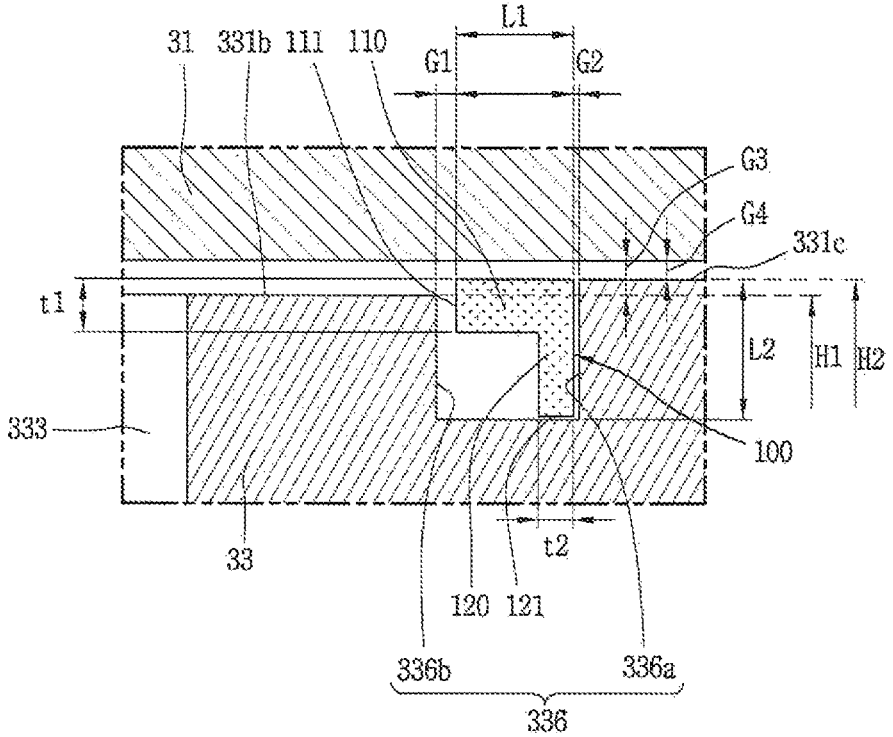
FIG. 7 is a sectional view taken along line in FIG. 6.

FIG. 5 is a perspective view illustrating a sealing member according to an embodiment. FIG. 6 is a planar view illustrating an inserted state of the sealing member of FIG. 5 into a sealing member insertion hole. FIG. 7 is a sectional view taken along line 'VII-VII' in FIG. 6.

As shown, the sealing member 100 according to this embodiment may be formed as a ring-shaped single body without a cut-out portion at a middle part or portion thereof. The sealing member 100 may be formed of a light material which is bendable according to a pressure, for example, Teflon.

The sealing member 100 may include a first sealing portion 110 formed in a ring shape, having an upper surface contacting a bottom surface of the main frame 31 and configured to seal a sealing member insertion groove 336 in the axial direction; and a second sealing portion 120 downward-extended from an edge of a bottom surface of the first sealing portion 110 in a ring shape, and configured to perform a sealing operation between the main frame 31 and the orbiting scroll 33 in the radial direction as its outer circumferential surface contacts an outer side wall surface of the sealing member insertion groove 336.

The first sealing portion 110 may be formed to have a '-'-shaped sectional surface, and the second sealing portion 120 may be formed to have a '|'-shaped sectional surface at the edge of the bottom surface of the first sealing portion 110. Thus, the sealing member 100 may have an entire '¬'-shaped sectional surface. With such a configuration, an inner side end 111 of the first sealing portion 110, an opposite side to one end from which the second sealing portion 120 is extended, forms a free end. A lower end 121 of the second sealing portion 120, that is, an opposite end to the end extended from the first sealing portion 110, forms a free end. Accordingly, the second sealing portion 120 forms a radial sealing portion as the lower end 121 thereof which forms a free end is outward bent according to a pressure of the sealing member insertion groove 336, and as the lower end 121 contacts an outer side wall surface of the sealing member insertion groove 336.

The first sealing portion 110 may be formed such that a radial width (L1) thereof may be larger than or equal to an axial thickness (t1) thereof. The second sealing portion 120 may be formed such that a radial thickness (t2) thereof may be smaller than or equal to an axial length (L2) thereof.

The axial thickness (t1) of the first sealing portion 110 may be greater than the radial thickness (t2) of the second sealing portion 120. Thus, a short lifespan of the first sealing portion 110 due to abrasion with the main frame 31 may be prevented, and the second sealing portion 120 may enhance a sealing effect in the radial direction as it is rapidly transformable in the radial direction.

An inner diameter (D1) of the sealing member (precisely, the first sealing portion) may be larger than an inner diameter (D2) of the sealing member insertion groove 336 by a first gap (G1). An outer diameter (D3) of the sealing member (precisely, the second sealing portion) may be smaller than an outer diameter (D4) of the sealing member insertion groove 336 by a second gap (G2). With such a configuration, high-pressure fluid (refrigerant and oil) inside of the sealing member 100 may be introduced into the sealing member insertion groove 336 through the first gap (G1) formed between the sealing member insertion groove 336 and the inner side end 111 of the sealing member 100. In this case, the sealing member 100 may be levitated by the pressure of the fluid. Further, as the second gap (G2) is formed between an outer side wall surface 336*a* of the sealing member insertion groove 336 and an outer circumferential surface of the sealing member 100, the sealing member 100 may be rapidly levitated by slidably-contacting the sealing member insertion groove 336 or not by contacting the sealing member insertion groove 336, without interfering with the sealing member insertion groove 336.

In order for the high-pressure fluid to be smoothly introduced into the first gap (G1), a height (H1) of the orbiting scroll (an inner side of the sealing member insertion groove 336, that is, a side of the first gap) may be lower than a height (H2) of the orbiting scroll (an outer side of the sealing member insertion groove 336, that is, a side of the second gap). For this as shown in FIG. 7, an inner side surface 331*b* of the orbiting scroll 33, which is positioned at an inner side than the sealing member insertion groove 336 on a rear surface of the orbiting scroll 33, may be formed to have a stair-step such that its height is lower than a height of an outer side surface 331*c* of the orbiting scroll 33. The outer side surface 331*c* of the orbiting scroll 33 is positioned at an outer side than the sealing member insertion groove 336, and forms a thrust bearing surface. With such a configuration, a third gap (G3) between the main frame 31 and the orbiting scroll 33 inside of the sealing member insertion groove 336, directly connected to the first gap (G1) is formed to be larger than a fourth gap (G4) between the main frame 31 and the orbiting scroll 33 outside at the sealing member insertion groove 336, the fourth gap (G4) directly connected to the second gap G2. As a result, the high-pressure fluid may be rapidly introduced into the first gap (G1).

Figure 8:
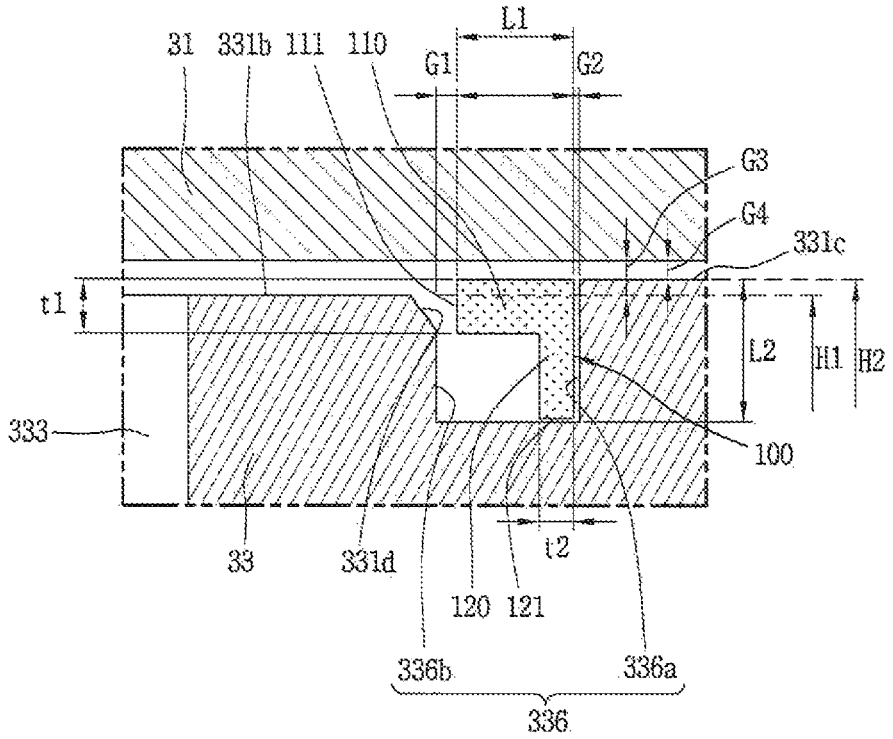
FIG. 8 is a longitudinal sectional view illustrating another embodiment of the sealing member insertion hole of an orbiting scroll in the scroll compressor of FIG. 3.

As shown in FIG. 8, a chamfering portion 331*d* is formed at an edge which connects the inner side surface 331*b* of the orbiting scroll 33 with an inner side wall surface 336*b* of the sealing member insertion groove 336. This may allow the high-pressure fluid to be introduced into the sealing member insertion groove 336 more rapidly.

Figure 9A:
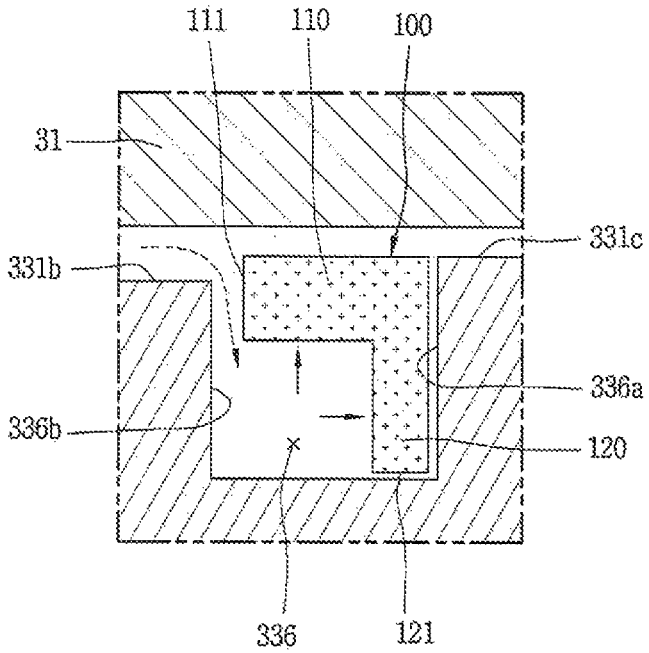
FIGS. 9A and 9B are longitudinal sectional views illustrating a position of the sealing member when the scroll compressor is stopped, and a position of the sealing member when the scroll compressor is operated.

In the scroll compressor according to this embodiment, once the scroll compressor starts driving, the compression part 3 suctioned a refrigerant, compresses the refrigerant, and then discharges the refrigerant of high pressure to the inner space 1*a* of the casing 1. Then, as shown in FIG. 9A, the high-pressure refrigerant is introduced into the sealing member insertion groove 336 via a region between the main frame 31 and the orbiting scroll 33, together with oil. Then, the high-pressure refrigerant presses a bottom surface of the first sealing portion 110 of the sealing member 100, and an inner circumferential surface of the second sealing portion 120.

Figure 9B:
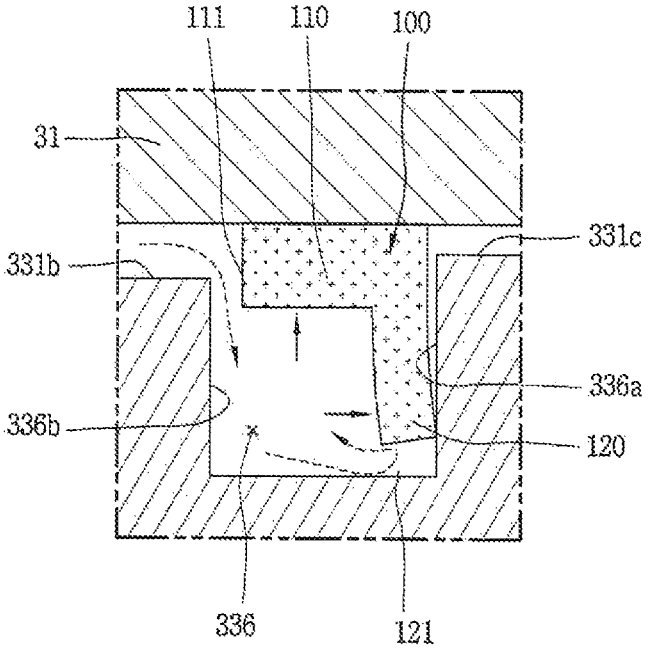

Then, as shown in FIG. 9B, the sealing member 100 levitates by the pressure applied to the bottom surface of the first sealing portion 110, and performs a sealing operation between the main frame 31 and the orbiting scroll 33 in an axial direction as an upper surface of the first sealing portion 110 contacts a bottom surface of the main frame 31. As the orbiting scroll 33 performs an orbiting motion, the first sealing portion 110 performs an orbiting motion in a state that its upper surface slidably contacts the bottom surface (thrust bearing surface) of the main frame 31. Thus, the first sealing portion 110 may have lowered reliability when operated for a long time, due to abrasion generated between itself and the main frame 31. However, as the axial thickness (t1) of the first sealing portion 110 is greater than the radial thickness (t2) of the second sealing portion 120 at least, the sealing member 100 may have a long lifespan.

Further, when a pressure is applied to an inner circumferential surface of the second sealing portion 120, the lower end 121 of the second sealing portion 120 is bent outward to contact the outer side wall surface 336*a* of the sealing member insertion groove 336, thereby sealing the sealing member insertion groove 336 in the radial direction. The second sealing portion 120 is levitated by a pressure of the sealing member insertion groove 336, as the sealing member is formed as a ring-shaped single body without a cut-out portion. Accordingly, if the radial thickness (t2) of the second sealing portion 120 is too great, the second sealing portion 120 is not bent when the scroll compressor is initially driven. This may cause leakage of a refrigerant in the radial direction. However, in a case where the radial thickness (t2) of the second sealing portion 120 is smaller than the axial thickness (t1) of the first sealing portion 110 at least, similarly to this embodiment, the second sealing portion 120 is rapidly bent even when the scroll compressor is initially driven. In this case, as the second sealing portion 120 performs a sealing operation between the frame and the orbiting scroll in the radial direction, performance of the scroll compressor may be enhanced.

Figure 10:
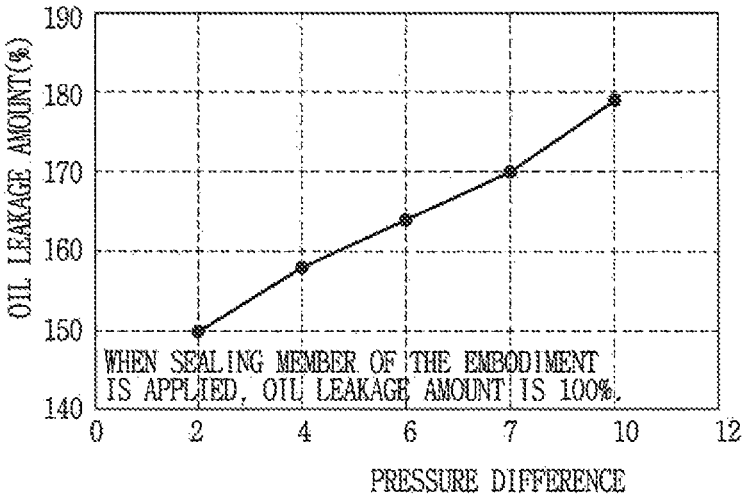
FIG. 10 is a graph comparing an oil leakage amount when the sealing member according to an embodiment is applied, with that when the conventional sealing member is applied.

FIG. 10 is a graph comparing an oil leakage amount when the sealing member according to an embodiment is applied, with that when the conventional sealing member is applied. As shown, when an oil leakage amount when the sealing member according to this embodiment is applied is 100%, an oil leakage amount when the conventional sealing member is applied is proportionally increased as a pressure difference is increased. Thus, the sealing member 100 according to this embodiment may prevent oil leakage to an intermediate pressure region even when a pressure difference between the inside and the outside of the sealing member 100 is high. This may allow the back pressure chamber (S) to have a uniform pressure, and may prevent an excessive contact between the orbiting scroll and the fixed scroll. This may enhance efficiency of the scroll compressor.

Other embodiments of the sealing member will be discussed hereinafter.

That is, in the aforementioned embodiment, the first and second sealing portions are formed to have a same sectional area. However in this embodiment, the second sealing portion is formed such that its sectional area is different in an axial direction.

Figure 11:
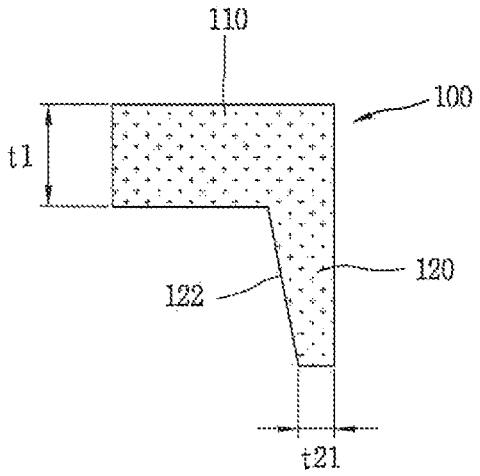
FIGS. 11 and 12 are longitudinal sectional views illustrating other embodiments of the sealing member.
Figure 12:
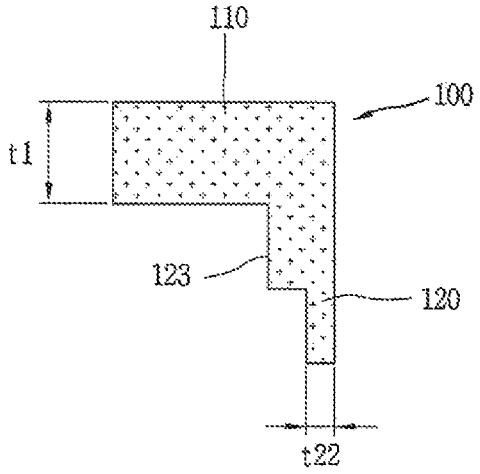

For example, as shown in FIG. 11, an inclined surface 122 may be formed on an inner circumferential surface of the second sealing portion 120, such that the second sealing portion 120 may have a decreased sectional area towards its lower end from its upper end. Alternatively, as shown in FIG. 12, a pressing portion 123 may be formed at a contact region between an inner circumferential surface of the second sealing portion 120 and a bottom surface of the first sealing portion 110. In this case, radial thicknesses (t21)(t22) of the second sealing portion 120 at a lower end may be smaller than the axial thickness (t1) of the first sealing portion 110.

The sealing member according to these embodiments is similar to that according to the aforementioned embodiment in a basic configuration and an operation effect, and thus, its detailed explanations has been omitted. In an embodiment shown in FIG. 11, a thickness (t21) of a lower end of the second sealing portion 120 in the radial direction is formed to be smaller than that of FIG. 7, and an area to receive a pressure from the lower end in the radial direction is obtained. As a result, not only a sealing force in the radial direction, but also a sealing force in the axial direction may be obtained. In an embodiment shown in FIG. 12, a thickness (t22) of the lower end of the second sealing portion 120 in the radial direction (t21) is formed to be very small, thereby enhancing a sealing effect in the radial direction. Further, as an area to receive a pressure in the axial direction by the pressing portion 123 is obtained, a sealing force in the axial direction may be obtained.

Another embodiment to levitate the sealing member will be discussed hereinafter.

Figure 13:
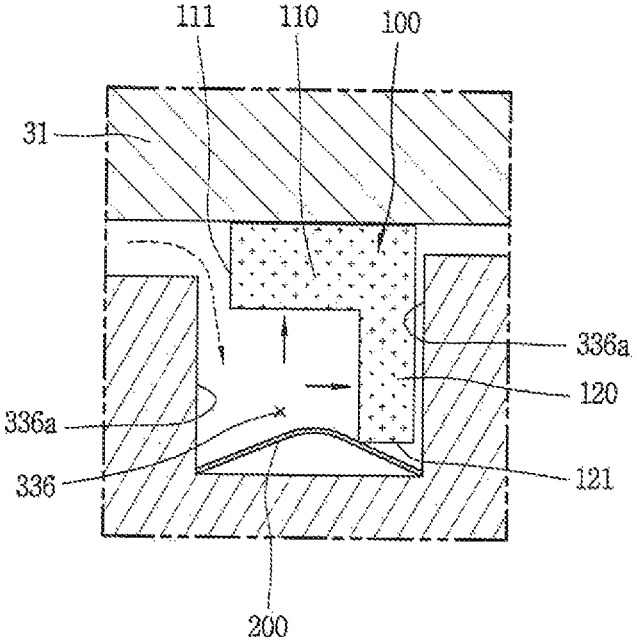
FIG. 13 is a longitudinal section view illustrating another embodiment to levitate the sealing member in the scroll compressor according to embodiments.

In the aforementioned embodiments, the sealing member is levitated by a pressure of fluid introduced into the sealing member insertion groove. However, in this embodiment shown in FIG. 13, an elastic member 200 is installed or provided at or in the sealing member insertion groove 336, such that the sealing member 100 is levitated by an elastic force of the elastic member 200.

In this case, as the sealing member 100 is levitated by the elastic member 200, the sealing member 100 may be rapidly levitated even when the scroll compressor is initially driven. This may allow a sealing force in an axial direction to be enhanced.

Although not shown, in FIG. 7, a curved surface may be formed between a bottom surface of the first sealing portion and an inner circumferential surface of the second sealing portion. In this case, damage of a region between the first and second sealing portions may be prevented.

Embodiments disclosed herein provide a scroll compressor capable of enhancing a sealing effect in a radial direction without forming a cut-out portion at a sealing member. Embodiments disclosed herein further provide a scroll compressor capable of stabilizing a behavior of an orbiting scroll by enhancing a sealing effect of a sealing member, and capable of preventing leakage of a refrigerant from a compression chamber.

Embodiments disclosed herein also provide a scroll compressor capable of preventing damage of a sealing member when the sealing member is applied to a compressor of a high compression ratio. Embodiments disclosed herein additionally provide a scroll compressor capable of rapidly levitating a sealing member even at an initial driving by reducing a weight of the sealing member and capable of forming a back pressure chamber within a short time.

Moreover embodiments disclosed herein provide a scroll compressor capable of reducing a weight of a sealing member, obtaining a sealing area in a radial direction and an axial direction, and obtaining a thickness of the sealing member against abrasion. Embodiments disclosed herein also provide a scroll compressor provided with a sealing member having a '⊓'-shaped sectional surface the sealing member inserted into a groove formed at one of two members which reciprocally perform a sliding motion, and configured to seal a space between contact surfaces of the two members while being levitated by a pressure difference.

The sealing member may be a formed as a single body having no cut-out portion. The sealing member may include a first portion having a 'l'-shaped sectional surface and forming a radial sealing portions contacting an outer side wall surface of the groove; and a second portion having a '-'-shaped sectional surface and forming an axial sealing portion by contacting a thrust surface of another member. The first portion may be formed to have a smaller thickness than the second portion.

Embodiments disclosed herein provide a scroll compressor that may include a motor part or motor which provides a drive force; an orbiting scroll which performs an orbiting motion by the motor part; a fixed scroll coupled to the orbiting scroll, and forming a compression chamber together with the orbiting scroll; a frame coupled to the fixed scroll, and configured to support the orbiting scroll; a sealing member mounting groove having a ring shape, and formed on a first facing surface of the frame contacting the orbiting scroll, or a second facing surface of the orbiting scroll contacting the frame; and a sealing member including a first sealing portion formed in a ring shape, inserted into the sealing member mounting groove so as to be moveable in an axial direction, and configured to perform a sealing operation between the frame and the orbiting scroll in the axial direction, and including a second sealing portion extending from the first sealing portion in the axial direction, and configured to perform a sealing operation between the frame and the orbiting scroll in a the direction by contacting an outer side wall surface of the sealing member mounting groove. A thickness of the second sealing portion in the radial direction may be smaller than a thickness of the first sealing portion in the axial direction. The sealing member may be formed as a single body, such that an outer diameter thereof may be smaller than an outer diameter of the sealing member mounting groove. An end of the second sealing portion, far from the first sealing portion in the axial direction, may be formed as a free end.

The second sealing portion may be formed such that a thickness of a first end where the first sealing portion is formed, may be smaller than that of a second end, an opposite side to the first end. The second sealing portion may be formed such that one of two side surfaces in the radial direction may be inclined, the one side surface which faces an inner side wall surface of the sealing member mounting groove.

A pressing portion may be formed on an inner side surface of the second sealing portion, at a part extended from the first sealing portion. A length of the pressing portion in the axial direction may be shorter than a length of the second sealing portion in the axial direction.

A stair-stepped surface having a predetermined depth may be formed on a facing surface of a member where the sealing member insertion groove is formed. The sealing member insertion groove may be formed on an outer circumferential surface of the stair-stepped surface. At a facing surface of a member where the sealing member insertion groove is formed, two sides on the basis of the sealing member insertion groove may have different heights.

One or more chamfering portions may be formed at a facing surface of a member where the sealing member insertion groove is formed, at an edge of an inner side wall surface of the sealing member insertion groove.

An interval between an inner side wall surface of the sealing member insertion groove and an end surface of the first sealing portion corresponding thereto, may be formed to be equal to or larger than an interval between the frame and the orbiting scroll at an inner side than the sealing member insertion groove.

An elastic member may be provided between a bottom surface of the sealing member insertion groove and an end surface of the second sealing portion corresponding thereto.

A thickness of the first sealing portion in the axial direction may be equal to or larger than a maximum gap between the frame and the orbiting scroll.

Embodiments disclosed herein further provide a scroll compressor that may include a casing configured to contain oil at a lower inner space thereof; a drive motor provided at a region spaced firm an upper end of the casing by a predetermined distance, such that an upper space is formed in the casing; a rotational shaft coupled to a rotor of the drive motor, and having an oil supply passage to upwardly guide the oil contained in the casing; a frame disposed or provided below the drive motor; a fixed scroll disposed or provided below the frame, and having a fixed wrap; an orbiting scroll provided between the frame and the fixed scroll, having an orbiting wrap to form a compression chamber by being engaged with the fixed wrap, having a rotational shaft coupling portion to couple the rotational shaft thereto in a penetrating manner, and having a sealing member insertion groove on a surface which faces the frame; and a sealing member including a first sealing portion formed in a ring shape, inserted into the sealing member insertion groove, and configured to perform a sealing operation between the frame and the orbiting scroll in an axial direction by contacting a bottom surface of the frame, and including a second sealing portion extending from an edge of a lower surface of the first sealing portion toward a bottom surface of the sealing member insertion groove, and configured to perform a sealing operation between the frame and the orbiting scroll in a radial direction by contacting an outer side wall surface of the sealing member insertion groove. An inner side end of the first sealing portion and a lower end of the second sealing portion form free ends. A thickness of the first sealing portion in the axial direction may be greater than a thickness of the second sealing portion in the radial direction.

An upper surface of the orbiting scroll positioned at an inner side than the sealing member insertion groove may have a height lower than a height of an upper surface of the orbiting scroll positioned at an outer side than the sealing member insertion groove.

The scroll compressor according to embodiments disclosed herein may have at least the following advantages.

First, as the sealing member provided between the orbiting scroll and the main frame is formed as a ring-shaped single body having no cut-out portion, a sealing effect of the sealing member in a radial direction may be enhanced. Second, as the sealing effect of the sealing member is enhanced, a back pressure chamber may maintain a constant pressure. This may allow the orbiting scroll to have a stable behavior, and may prevent refrigerant leakage from the compression chambers to thus enhance compression efficiency.

Further, as the sealing member is not provided with a cut-out portion, the sealing member may have enhanced reliability without damage when applied to a compressor of a high compression ratio. Furthermore, with a structure that the sealing member includes first and second sealing portions and the second sealing portion is formed to be thinner than the first sealing portion, a weight of the sealing member may be reduced. This may allow the sealing member to be rapidly levitated even at an initial driving of the scroll compressor, resulting in enhancing compression efficiency.

Also, as the first sealing portion is formed to have a great thickness, a short lifespan of the first sealing portion due to abrasion may be prevented. As the second sealing portion is formed to have a small thickness, it may be rapidly bent even at an initial driving of the scroll compressor thereby forming a radial sealing portion.

Further scope of applicability will become more apparent from the detailed description given. However, it should be understood that the detailed description and specific examples, while indicating embodiments are given by way of illustration only, as various changes and modifications within the spirit and scope of the invention will become apparent to those skilled in the art from the detailed description.

The foregoing embodiments and advantages are merely exemplary and are not to be considered as limiting. The present teachings can be readily applied to other types of apparatuses. This description is intended to be illustrative, and not to limit the scope of the claims. Many alternatives, modifications and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a motor that provides a drive force;

an orbiting scroll driven by the motor to perform an orbiting motion;

a fixed scroll coupled to the orbiting scroll, and forming a compression chamber together with the orbiting scroll;

a frame coupled to the fixed scroll and configured to support the orbiting scroll;

a sealing member mounting groove having a ring shape, and formed on a first surface of the frame that contacts the orbiting scroll or a second surface of the orbiting scroll that contacts the frame; and a sealing member including a first sealing portion formed in a ring shape, inserted into the sealing member mounting groove so as to be moveable in an axial direction; and configured to perform a sealing operation between the frame and the orbiting scroll in the axial direction, and including a second sealing portion that extends from the first sealing portion in the axial direction, and configured to perform a sealing operation between the frame and the orbiting scroll in a radial direction by contacting an outer side wall surface of the sealing member mounting groove, wherein a thickness of the second sealing portion in the radial direction is less than a thickness of the first sealing portion in the axial direction, wherein the sealing member is formed from a single body, wherein an outer diameter of the sealing member is less than an outer diameter of the sealing member mounting groove, wherein the sealing member has a free end corresponding to an end of the second sealing portion that is extended away from the first sealing portion in the axial direction, and wherein an axial length of the second sealing portion that protrudes from the first sealing portion in the axial direction is greater than the thickness of the first sealing portion in the axial direction.

2. The scroll compressor of claim 1, wherein the second sealing portion is formed such that a thickness of a first end at which the first sealing portion is formed, is larger than a thickness of a second end, at an opposite side to the first end.

3. The scroll compressor of claim 2, wherein the second sealing portion is formed such that one of two side surfaces in the radial direction is inclined, the one side surface being a surface which faces an inner side wall surface of the sealing member mounting groove.

4. The scroll compressor of claim 1, wherein a pressing portion is formed on an inner side surface of the second sealing portion at a portion that extends from the first sealing portion, and wherein a length of the pressing portion in the axial direction is shorter than a length of the second sealing portion in the axial direction.

5. The scroll compressor of claim 1, wherein a stair-stepped surface having a predetermined depth is formed on either the first surface or the second surface at which the sealing member mounting groove is formed and wherein the sealing member mounting groove is formed on an outer circumferential surface of the stair-stepped surface.

6. The scroll compressor of claim 1, wherein the sealing member mounting groove has two sides that have different heights with respect to a bottom surface of the sealing member mounting groove.

7. The scroll compressor of claim 1, wherein one or more chamfering portion is formed at either the first surface or the second surface at which the sealing member mounting groove is formed, at an edge of an inner side wall surface of the sealing member mounting groove.

8. The scroll compressor of claim 1, wherein an interval between an inner side wall surface of the sealing member mounting groove and an end surface of the first sealing portion corresponding thereto, is formed to be equal to or larger than an interval between the frame and the orbiting scroll at an inner side than the sealing member mounting groove.

9. The scroll compressor of claim 1, wherein an elastic member is provided between a bottom surface of the sealing member mounting groove and an end surface of the second sealing portion corresponding thereto.

10. The scroll compressor of claim 1, wherein the thickness of the first sealing portion in the axial direction is equal to or larger than a maximum gap between the frame and the orbiting scroll.

11. A scroll compressor, comprising:

a casing configured to contain oil at a lower inner space thereof;

a drive motor provided at a region spaced from an upper end of the casing by a predetermined distance, such that an upper space is formed in the casing;

a rotational shaft coupled to a rotor of the drive motor, and having an oil supply passage to upwardly guide the oil contained in the casing;

a frame disposed below the drive motor;

a fixed scroll disposed below the frame, and having a fixed wrap;

an orbiting scroll provided between the frame and the fixed scroll, having an orbiting wrap to form a compression chamber by being engaged with the fixed wrap, a rotational shaft coupling portion to couple the rotational shaft to the orbiting scroll in a penetrating manner, and a sealing member insertion groove on a surface which faces the frame; and a sealing member including a first sealing portion formed in a ring shape, inserted into the sealing member insertion groove, and configured to perform a sealing operation between the frame and the orbiting scroll in an axial direction by contacting a bottom surface of the frame, and including a second sealing portion that extends from an edge of a lower surface of the first sealing portion toward a bottom surface of the sealing member insertion groove, and configured to perform a sealing operation between the frame and the orbiting scroll in a radial direction by contacting an outer side wall surface of the sealing member insertion groove, wherein an inner side end of the first sealing portion and a lower end of the second sealing portion form free ends, wherein a radial thickness of the second sealing portion in the radial direction is less than an axial thickness of the first sealing portion in the axial direction, wherein a radial thickness of the first sealing portion in the radial direction is greater than or equal to the axial thickness of the first sealing portion, and wherein the radial thickness of the second sealing portion is less than or equal to an axial length of the second sealing portion in the axial direction.

12. The scroll compressor of claim 11, wherein an upper surface of the orbiting scroll positioned at an inner side than the sealing member insertion groove has a height lower than a height of an upper surface of the orbiting scroll positioned at an outer side than the sealing member insertion groove.

13. A scroll compressor, comprising:

a motor that provides a drive force;

a first scroll driven by the motor to perform an orbiting motion;

a second scroll coupled to the first scroll, and forming a compression chamber together with the first scroll;

a frame coupled to the second scroll, and configured to support the first scroll;

a sealing member mounting groove formed on a first surface of the frame that contacts the first scroll; and a sealing member including a first sealing portion inserted into the sealing member mounting groove so as to be moveable in an axial direction, and configured to perform a sealing operation between the frame and the first scroll in the axial direction, and including a second sealing portion that extends from the first sealing portion in the axial direction, and configured to perform a sealing operation between the frame and the first scroll in a radial direction by contacting an outer side wall surface of the sealing member mounting groove, wherein a radial thickness of the second sealing portion in the radial direction is less than an axial thickness of the first sealing portion in the axial direction, wherein a radial thickness of the first sealing portion in the radial direction is greater than or equal to the axial thickness of the first sealing portion, and wherein the radial thickness of the second sealing portion is less than or equal to an axial length of the second sealing portion in the axial direction.

14. The scroll compressor of claim 13, wherein the sealing member is formed as a single body, such that an outer diameter thereof is smaller than an outer diameter of the sealing member mounting groove, and wherein an end of the second sealing portion that extends away from the first sealing portion in the axial direction, is formed as a free end.

15. The scroll compressor of claim 13, wherein the second sealing portion is formed such that a thickness of a first end at which the first sealing portion is formed, is larger than a thickness of a second end, at an opposite side to the first end.

16. The scroll compressor of claim 13, wherein a pressing portion is formed on an inner side surface of the second sealing portion, at a portion that extends from the first sealing portion, and wherein a length of the pressing portion in the axial direction is shorter than a length of the second sealing portion in the axial direction.

17. The scroll compressor of claim 13, wherein sides of the sealing member mounting groove have different heights.

18. The scroll compressor of claim 13, wherein an edge of an inner side wall surface of the sealing member mounting groove is chamfered.

19. The scroll compressor of claim 13, wherein an elastic member is provided between a bottom surface of the sealing member mounting groove and an end surface of the second sealing portion corresponding thereto.

20. The scroll compressor of claim 13, wherein the axial thickness of the first sealing portion in the axial direction is equal to or larger than a maximum gap between the frame and the first scroll.

* * * * *